US011441306B2

(12) United States Patent
Ke

(10) Patent No.: US 11,441,306 B2
(45) Date of Patent: Sep. 13, 2022

(54) PUMP-STORAGE DEVICE AND PUMP-STORAGE SEWAGE TRUCK INCLUDING THE SAME

(71) Applicant: Shih-Yuan Ke, Chia Yi Hsien (TW)

(72) Inventor: Shih-Yuan Ke, Chia Yi Hsien (TW)

( * ) Notice: Subject to any disclaimer, the term of this patent is extended or adjusted under 35 U.S.C. 154(b) by 438 days.

(21) Appl. No.: 16/752,812

(22) Filed: Jan. 27, 2020

(65) Prior Publication Data

US 2021/0071407 A1 Mar. 11, 2021

(30) Foreign Application Priority Data

Sep. 5, 2019 (TW) ..... 108132085

(51) Int. Cl.
*E03F 7/10* (2006.01)

(52) U.S. Cl.
CPC ..... *E03F 7/103* (2013.01); *E03F 7/106* (2013.01)

(58) Field of Classification Search
CPC ..... E03F 7/103; E03F 7/106
See application file for complete search history.

(56) References Cited

U.S. PATENT DOCUMENTS 1,754,870 A 4/1930 Wickes
2,179,246 A 11/1939 Applebaum
3,040,785 A * 6/1962 Grindle ..... A01K 1/01 222/626
3,302,575 A 2/1967 Jennings
3,306,448 A 2/1967 Baker
3,378,025 A * 4/1968 Hilde, Jr. ..... E03F 7/10 137/255
3,434,598 A 3/1969 Daman
3,515,370 A 6/1970 Jester et al.
3,706,319 A * 12/1972 Neese ..... E03F 7/10 141/59
5,244,019 A * 9/1993 Derby ..... B65B 1/26 222/452
6,790,368 B1 * 9/2004 Vachon ..... E03F 7/103 15/340.1

(Continued)

OTHER PUBLICATIONS

Office Action from related U.S. Appl. No. 15/956,694.

*Primary Examiner* — Timothy L Maust
(74) *Attorney, Agent, or Firm* — Fresh IP PLC; Clifford D. Hyra; Aubrey Y. Chen

(57) ABSTRACT

A pump-storage device comprises a treatment container including an interior separated by a partitioning board into an upper chamber and a lower chamber intercommunicating with the upper chamber via a first intercommunication port. An inlet intercommunicates with the upper chamber. A second intercommunication port intercommunicates the lower chamber with an outside. A first control valve controls intercommunication between the upper and lower chambers. A second control valve controls intercommunication between the upper chamber and a gas suction source. An actuation rod extends through the first intercommunication port. A first fixing block, a second fixing block, and a third fixing block are mounted from top to bottom in sequence on the actuation rod. An upper stop plate is disposed between the first and second fixing blocks. A lower stop plate is disposed between the second and third fixing blocks. The upper and lower stop plates are elastically supported.

18 Claims, 7 Drawing Sheets

(56) References Cited

U.S. PATENT DOCUMENTS

| | | | | |
|---|---|---|---|---|
| 7,429,319 | B2 * | 9/2008 | Davis | B30B 9/067 15/340.1 |
| 7,461,829 | B2 * | 12/2008 | Rule | F16K 1/38 251/359 |
| 8,574,430 | B2 | 11/2013 | Chajec | |
| 8,919,391 | B1 * | 12/2014 | Harvey | B67D 7/0277 141/98 |
| 10,526,777 | B2 * | 1/2020 | Ke | E03F 5/22 |
| 2021/0071407 | A1 * | 3/2021 | Ke | E03F 7/106 |

* cited by examiner

PUMP-STORAGE DEVICE AND PUMP-STORAGE SEWAGE TRUCK INCLUDING THE SAME

This application claims priority from Taiwan patent application 108132085, filed on Sep. 5, 2019, incorporated herein by reference.

BACKGROUND OF THE INVENTION

The present invention relates to a pump-storage device and a pump-storage sewage truck and, more particularly, to a pump-storage device and a pump-storage tank truck for pumping filthy substances, such as sludge, fecal-sewage or chemical pollutants.

Populations are highly concentrated in cities due to urbanization. With the increase of the urban population, the consumption of water and sewage quantity increase, and the sewage treatment has become an important issue. Nowadays, sewage is delivered through sewage pipelines to sewage plants for proper treatment. However, sewage often carries oil stain, sludge, and debris, all of which flow into the treatment pipes, leading to blockage of the pipes. Periodic maintenance is necessary for smooth flow of the pipes. Sewage trucks are an important tool for cleaning filthy substances, such as sludge in gutters, sewage in septic tanks, or chemical pollutants in chemical tanks. A sewage truck can deliver the filthy substances blocking the pipes into a tank and can transport to a professional facility for treatment.

A conventional sewage truck includes a tank for receiving filthy substances. An end of an inlet is in communication with the tank. A vacuum pump is connected to the tank. Before sucking filthy substances, the vacuum pump is started to expel the air in the tank, creating a near vacuum state in the tank to thereby create a vacuum force. The other end of the inlet extends into a bottom of a gutter, a septic tank, or a chemical tank, such that the filthy substances can enter the tank via the inlet.

However, the conventional pump-storage sewage truck has a larger tank and, thus, requires a larger vacuum pump that needs a longer time to create a near vacuum state in the tank. Thus, improvement to the conventional pump-storage devices is necessary.

BRIEF SUMMARY OF THE INVENTION

To solve the above problems, an objective of the present invention is to provide a pump-storage device and a pump-storage sewage truck, with the pump-storage device using a small-size gas suction source and proceeding the cleaning operation in a short period of time.

Another objective of the present invention is to provide a pump-storage device and a pump-storage sewage truck for more precisely controlling sucking or discharge of filthy substances.

A further objective of the present invention is to provide a pump-storage device and a pump-storage sewage truck for filtering volatile substances in a gas or liquid in a to-be-pumped environment before discharge, reducing air pollution caused by odor or toxic gases flowing into the ambient air.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

As used herein, the term "one" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "join", "assembly", or similar terms is used to include separation of connected members without destroying the members after connection or inseparable connection of the members after connection. A person having ordinary skill in the art would be able to select according to desired demands in the material or assembly of the members to be connected.

A pump-storage device according to the present invention comprises:

a treatment container including an interior separated by a partitioning board into an upper chamber and a lower chamber, wherein the upper chamber intercommunicates with the lower chamber via a first intercommunication port, wherein the treatment container further includes an inlet intercommunicating with the upper chamber and a second intercommunication port intercommunicating the lower chamber with an outside;

a switching module including a first control valve and a second control valve, wherein the first control valve is configured to control intercommunication between the upper chamber and the lower chamber, and wherein the second control valve is configured to control intercommunication between the upper chamber and a gas suction source;

a telescopic module including an actuation rod and an actuation cylinder controlling telescopic movement of the actuation rod, wherein the actuation rod extends through the first intercommunication port; and an intercommunication control module including a first fixing block, a second fixing block, and a third fixing block which are mounted from top to bottom in sequence on the actuation rod, wherein an upper stop plate is disposed between the first fixing block and the second fixing block, wherein a lower stop plate is disposed between the second fixing block and the third fixing block, and wherein the upper stop plate and the lower stop plate are elastically supported by an elastic unit.

A pump-storage sewage truck according to the present invention comprises the pump-storage device, a tank, and a transportation tool. The pump-storage device is assembled to the tank. The second intercommunication port of the treatment container intercommunicates with an interior of the tank. The tank and the gas suction source are mounted to the transportation tool.

Thus, in the pump-storage device and the pump-storage sewage truck according to the present invention, the vacuum operation is carried out in a treatment container with a smaller volume, such that a small-size gas suction source can be used, and a near vacuum state can be reached in a short period of time, rapidly starting the cleaning operation. This not only efficiently reduces the operation cost of the pump-storage sewage truck but also significantly improves the pumping operation efficiency. Furthermore, the pump-storage device according to the present invention includes the intercommunication control module using the elastic unit to more precisely control the suction or discharge of the filthy substances, also improving the pumping operation efficiency.

In an example, the elastic unit includes a positioning seat having two ends abutting against a first elastic element and a second elastic element, respectively. The first elastic element elastically abuts against the upper stop plate. The second elastic element elastically abuts against the lower stop plate. Thus, the positioning seat separates the first elastic element from the second elastic element to prevent safety accidents resulting from sparks caused by rubbing between the first and second elastic elements, thereby improving the use safety.

In an example, the intercommunication control module includes a first anti-fouling sleeve and a second anti-fouling sleeve. The first anti-fouling sleeve and the second anti-fouling sleeve are movably mounted around the actuation rod. The first anti-fouling sleeve is located above the positioning seat. A projection of the first anti-fouling sleeve in a radial direction overlaps with a projection of an end of the positioning seat in a radial direction. The second anti-fouling sleeve is located below the positioning seat. A projection of the second anti-fouling sleeve overlaps with a projection of another end of the positioning seat. Thus, the first and second anti-fouling sleeves prevent a large amount of the filthy substances in the treatment container from sticking to the first and second elastic elements, avoiding adverse influence on operation of the first and second elastic elements and improving the operational smoothness.

In an example, the first stop plate and the first fixing block have a gap therebetween when the first elastic element and the second elastic element are not compressed by an external force. Thus, the operational smoothness and operational efficiency are improved.

In an example, the second elastic element is biased to elastically press against the lower stop plate and to press the positioning seat against the second fixing block. Thus, the operational smoothness and operational efficiency are improved.

In an example, the first control valve intercommunicates with the upper chamber via a first duct, intercommunicates with the lower chamber via a second duct, and intercommunicates with the outside of the treatment container via a third duct. When the control valve controls the first duct to intercommunicate with the second duct, the second duct does not intercommunicate with the third duct. When the first control valve controls the first duct not to intercommunicate with the second duct, the second duct intercommunicates with the third duct. Thus, the operational smoothness and operational efficiency are improved.

In an example, the second control valve intercommunicates with the upper chamber via a fourth duct. A protecting unit includes a housing connected to the fourth duct. The housing includes a bottom intercommunicating with the upper chamber. A float is received in the housing. The housing includes a vent located above the float. Thus, when the filthy substances fill the upper chamber and leak into the bottom of the housing, the float floats upwards to block the intercommunication between the upper chamber and the fourth duct, improving the use safety.

In an example, the switching module includes a liquid level detector configured to detect a liquid level in the lower chamber. When the liquid level detector detects that the liquid level reaches a predetermined value, the first control valve is switched between an open state and a closed state. Thus, the operational convenience is improved.

In an example, the switching module includes a timer configured to set a period of time of release, and wherein when the period of time of release expires, the first control valve is switched to an open state. Thus, the operational convenience is improved.

In an example, the switching module includes a filter intercommunicating with the second control valve. The gas suction source intercommunicates with the filter by a gas suction tube. Thus, the gas flowing out of the upper chamber is filtered by the filter before being discharged to the outside, avoiding air pollution.

The present invention will become clearer in light of the following detailed description of illustrative embodiments of this invention described in connection with the drawings.

DETAILED DESCRIPTION OF THE INVENTION

Figure 1:
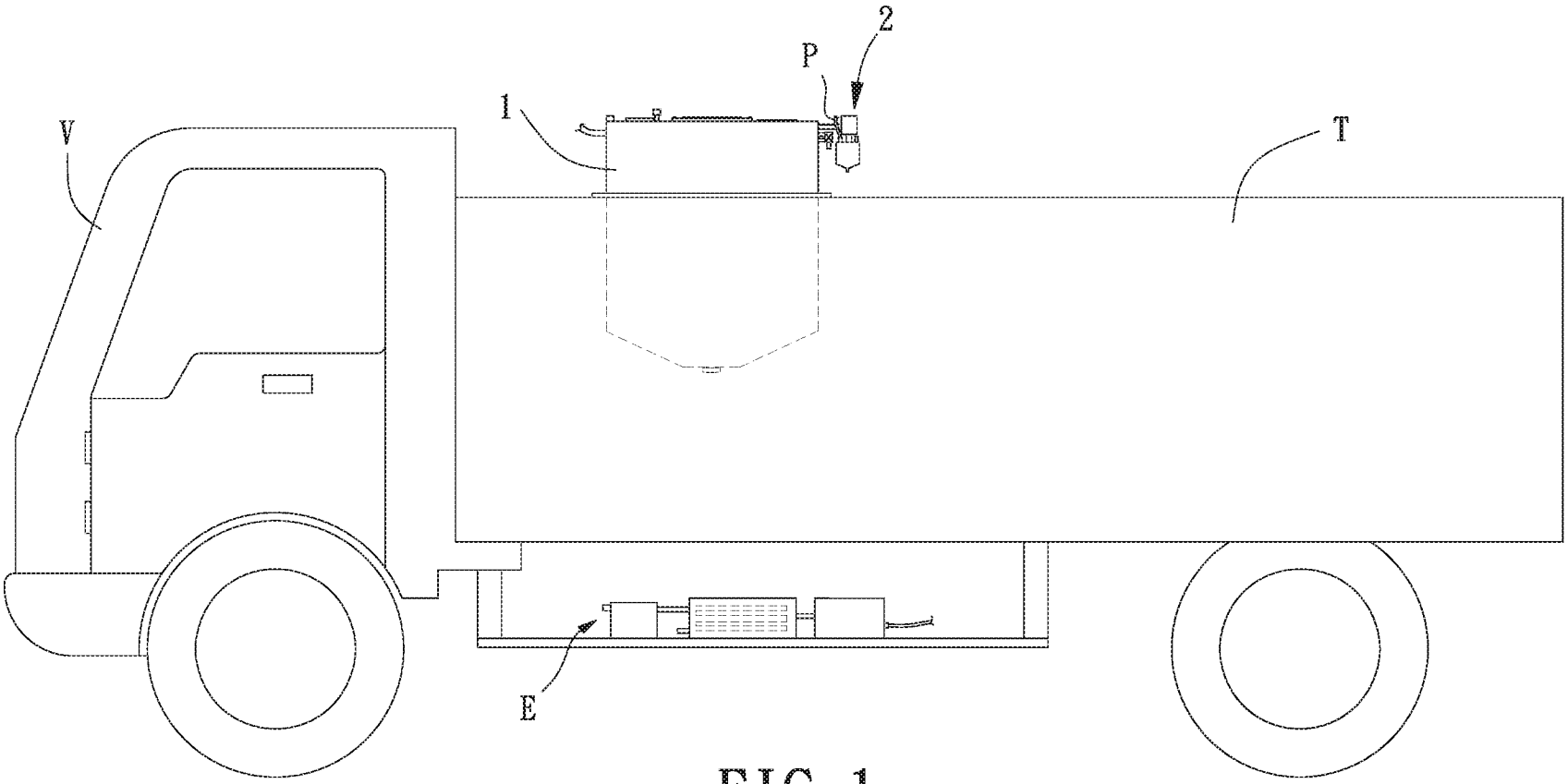
FIG. 1 is a diagrammatic view of a pump-storage sewage truck including a pump-storage device of an embodiment according to the present invention.
Figure 2:
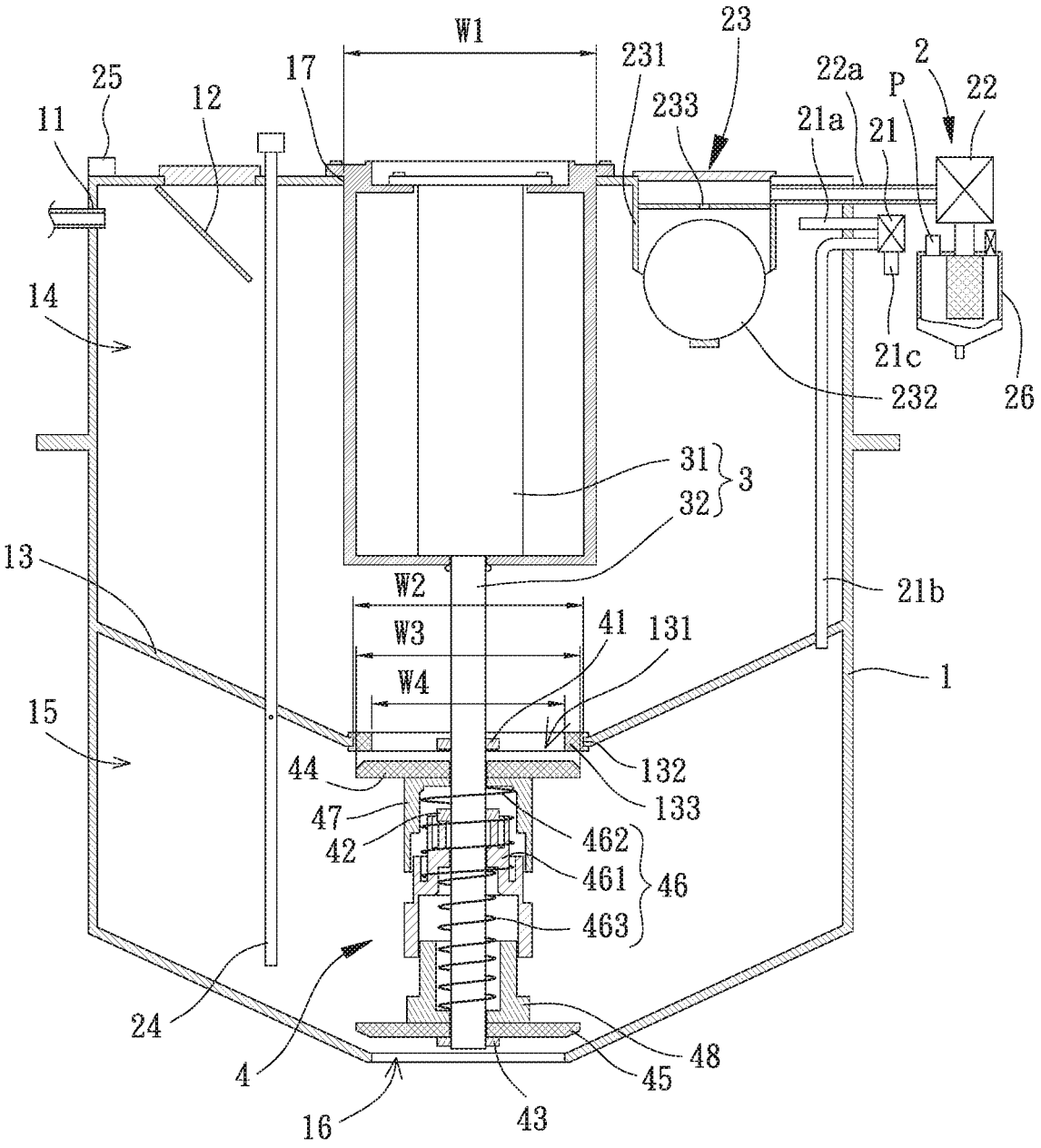
FIG. 2 is a diagrammatic cross sectional view of the pump-storage device according to the present invention.

With reference to FIGS. 1 and 2, a pump-storage device of an embodiment according to the present invention can be assembled to a tank T, and the tank T and a gas suction source E can be mounted on a transportation tool V to form a pump-storage sewage truck. The pump-storage device includes a treatment container 1, a switching module 2, a telescopic module 3, and an intercommunication control module 4. The switching module 2 is mounted to the treatment container 1. The telescopic module 3 and an intercommunication control module 4 are mounted inside the treatment container 1.

The treatment container 1 includes an inlet 11 that can be connected to a feeding tube, such that the filthy substances to be sucked can be guided from the feeding tube into an interior of the treatment container 1 via the inlet 11. A swirling member 12 is mounted in the treatment container 1 and is located near the inlet 11, such that filthy substances, such as sludge, fecal sewage, or chemical pollutants, entering the treatment container 1 via the inlet 11 can create a stable swirling flow without incurring large dissipation or large volatilization resulting from impact. The interior of the treatment container 1 is separated by a partitioning board 13 into an upper chamber 14 and a lower chamber 15. The inlet 11 intercommunicates with the upper chamber 14. The partitioning board 13 includes a first intercommunication port 131 for intercommunicating the upper chamber 14 with the lower chamber 15. The partitioning board 13 can be in the shape of a funnel, and the first intercommunication port 131 is located at a lower position, such that the filthy substances guided into the upper chamber 14 can smoothly pass through the first intercommunication port 131 into the lower chamber 15, reducing the residual. The treatment container 1 further includes a second intercommunication port 16 intercommunicating the lower chamber 15 with the outside. The bottom of the treatment container 1 can also be in the shape of a funnel and can be located at a lower position, such that the filthy substances guided into the lower chamber 15 can smoothly pass through the second intercommunication port 16, can timely leave the treatment container 1, and preferably enters the tank T that is mounted on the transportation tool V and that has a larger volume.

The switching module 2 includes a first control valve 21 intercommunicating with the upper chamber 14 via a first duct 21*a*, intercommunicating with the lower chamber 15 via a second duct 21*b*, and intercommunicating with the outside of the treatment container 1 via a third duct 21*c*. When the first control valve 21 is opened, the first duct 21*a* intercommunicates with the second duct 21*b*, and the second duct 21*b* does not intercommunicate with the third duct 21*c*. Thus, the upper chamber 14 intercommunicates with the lower chamber 15 and does not intercommunicate with the outside of the treatment container 1. When the first control valve 21 is closed, the second duct 21*b* intercommunicates with the third duct 21*c*, and the first duct 21*a* does not intercommunicate with the second duct 21*b*. Thus, the upper chamber 14 does not intercommunicate with the lower chamber 15, and the lower chamber 15 intercommunicates with the outside of the treatment container 1.

The switching module 2 further includes a second control valve 22 configured to control intercommunication between the upper chamber 14 and a gas suction source E. In a non-restrictive example, this embodiment sets that when the second control valve 22 is open, the gas suction source E intercommunicates with the upper chamber 14 and sucks gas out of the upper chamber 14 to reduce the pressure in the upper chamber 14 to be smaller than the atmosphere. When the second control valve 22 is closed, the upper chamber 14 does not intercommunicate with the gas suction source E.

More specifically, the second control valve 22 intercommunicates with the upper chamber 14 via a fourth duct 22*a*. The switching module 2 preferably includes a protecting unit 23 having a housing 231 connected to the fourth duct 22*a*. The housing 231 includes a bottom intercommunicating with the upper chamber 14. Thus, the fourth duct 22*a* can intercommunicate an interior of the housing 231 with the upper chamber 14. Furthermore, the housing 231 includes a float 232 received therein and a vent 233 located above the float 232. Thus, when the filthy substances fill the upper chamber 14 and leak into the bottom of the housing 231, the float 232 floats upwards to seal the vent 233, thereby blocking the intercommunication between the upper chamber 14 and the fourth duct 22*a*.

Furthermore, the switching module 2 further includes a liquid level detector 24, a timer 25, and a filter 26. The liquid level detector 24 is configured to detect a liquid level in the lower chamber 15. When the liquid level detector 24 detects that the liquid level reaches a predetermined value, the first control valve 21 is switched between an open state and a closed state. The timer 25 is configured to set a period of time of release. When the period of time of release expires, the first control valve 21 is switched to the open state. The period of time of release can be set according to the time required for discharging all of the filthy substances in the lower chamber 15 after the second intercommunication port 16 is opened after the predetermined liquid level of the lower chamber 15 is reached. For example, when the filthy substances in the lower chamber 15 can be completely discharged in 3 seconds, the period of time of release is set as 3 seconds. The gas suction source E can intercommunicate with the filter 26 via a gas suction pipe P and is then connected to the second control valve 22 via the filter 26. Thus, the gas flowing out of the upper chamber 14 can be filtered by the filter 26 to remove odorants, particles, debris, or hazardous materials in the gas. Next, the gas passes through the gas suction pipe P and the suction source E to the outside.

The telescopic module 3 includes an actuation rod 32 and an actuation cylinder 31 controlling axial telescopic movement of the actuation rod 32. In this embodiment, the actuation cylinder 31 is disposed in a location adjacent to the upper portion of the upper chamber 14. The actuation rod 32 extends through the first intercommunication port 131 and extends into the lower chamber 15 for connection with the intercommunication control module 4.

The intercommunication control module 4 is mounted to the actuation rod 32 and is substantially in the lower chamber 15. The intercommunication control module 4 displaces relative to the treatment container 1 in response to the axial telescopic movement of the actuation rod 32. Specifically, the intercommunication control module 4 includes a first fixing block 41, a second fixing block 42, and a third fixing block 43 which are mounted from top to bottom in sequence on the actuation rod 32 and which are spaced from each other. Thus, the first, second, and third fixing blocks 41, 42, and 43 can move jointly with the actuation rod 32. An upper stop plate 44, a lower stop plate 45, and an elastic unit 46 are mounted around the actuation rod 32 to move vertically relative to the actuation rod 32. The upper stop plate 44 is disposed between the first fixing block 41 and the second fixing block 42. The lower stop plate 45 is disposed between the second fixing block 42 and the third fixing block 43. The elastic unit 46 is disposed between the upper stop plate 44 and the lower stop plate 45 for elastically supporting the upper and lower stop plates 44 and 45. In this embodiment, the elastic unit 46 includes a positioning seat 461 having two ends abutting against a first elastic element 462 and a second elastic element 463, respectively. The first elastic element 462 elastically abuts against the upper stop plate 44. The second elastic element 463 elastically abuts against the lower stop plate 45. Thus, the positioning seat 461 separates the first elastic element 462 from the second elastic element 463 to prevent safety accidents resulting from sparks caused by rubbing between the first and second elastic elements 462 and 463, thereby improving the use safety.

Furthermore, the intercommunication control module 4 preferably includes a first anti-fouling sleeve 47 and a second anti-fouling sleeve 48. The first anti-fouling sleeve 47 and the second anti-fouling sleeve 48 are movably mounted around the actuation rod 32. The first anti-fouling sleeve 47 is located above the positioning seat 461. A projection of the first anti-fouling sleeve 47 in a radial direction overlaps with a projection of an end of the positioning seat 461 in a radial direction. The second anti-fouling sleeve 48 is located below the positioning seat 461. A projection of the second anti-fouling sleeve 48 overlaps with a projection of another end of the positioning seat 461. Thus, the first and second anti-fouling sleeves 47 and 48 prevent a large amount of the filthy substances in the treatment container 1 from sticking to the first and second elastic elements 462 and 463, avoiding adverse influence on operation of the first and second elastic elements 462 and 463. In this embodiment, the first elastic element 462 presses against the first anti-fouling sleeve 47, which, in turn, presses against the upper stop plate 44. Likewise, the second elastic element 463 presses against the second anti-fouling sleeve 48, which, in turn, presses against the lower stop plate 45.

It is worth noting that when the first elastic element 462 and the second elastic element 463 are not compressed by an external force, the upper stop plate 44 presses against a top side of the first anti-fouling sleeve 47 under the action of gravitational force, and the upper stop plate 44 and the first fixing block 41 have a gap therebetween. Preferably, the second elastic element 463 is biased to press against the second anti-fouling sleeve 48 to indirectly and elastically press against the lower stop plate 45 and to press the positioning seat 461 against the second fixing block 42.

Figure 3:
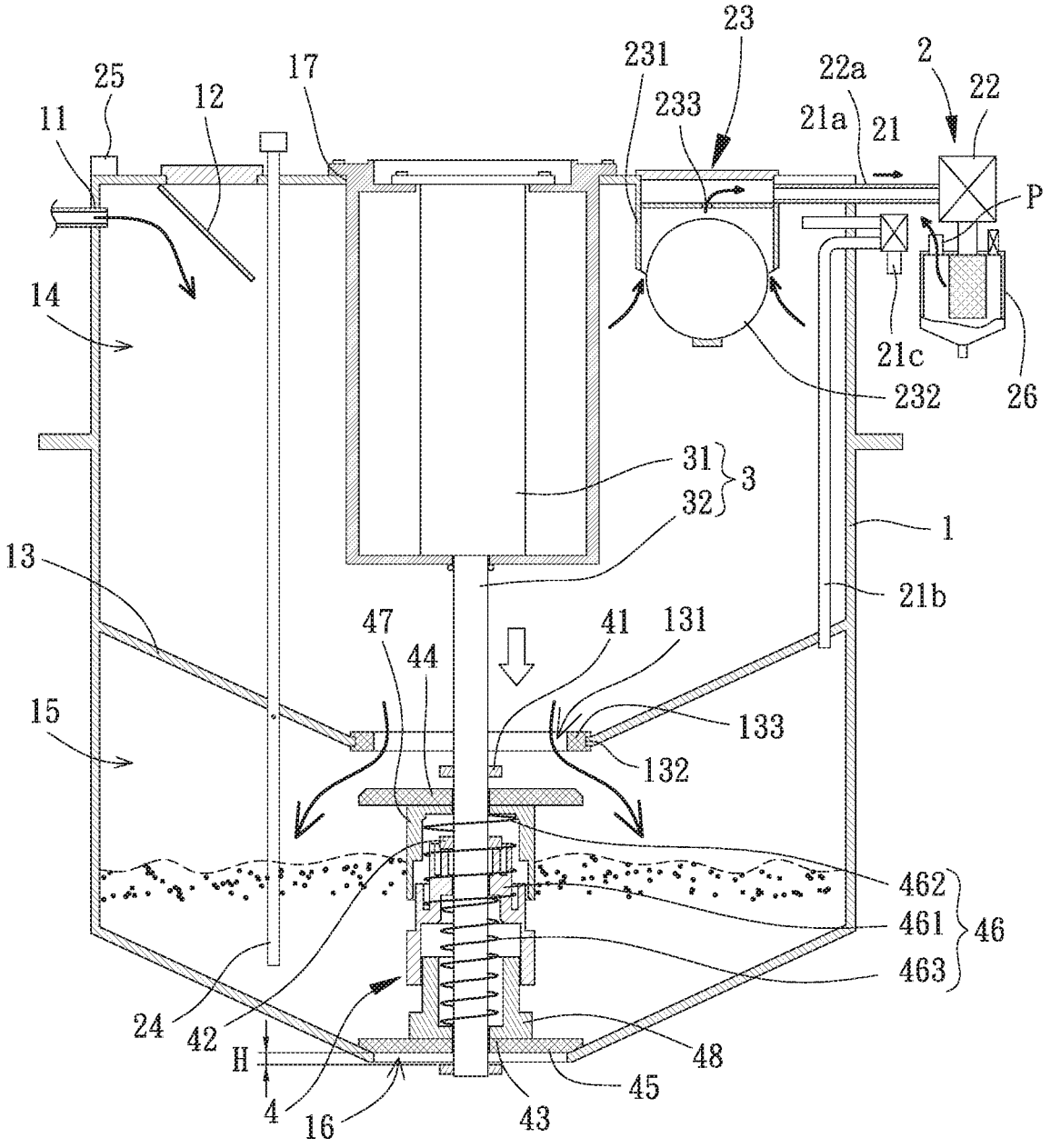
FIG. 3 shows suction of filthy substances of the pump-storage device of FIG. 2.

With reference to FIGS. 2 and 3, based on the above structure, when it is desired to suck the filthy substances into the treatment container 1, the first control valve 21 and the second control valve 22 are controlled to open simultaneously, and the actuation cylinder 31 and the gas suction source E (see FIG. 1) are activated. Thus, the actuation cylinder 31 operates to extend the actuation rod 32 downwards. The first, second, and third fixing blocks 41, 42, and 43 fixed on the actuation rod 32 also move downwards. After the lower stop plate 45 seals the second intercommunication port 16, the third fixing block 43 still moves downwards to separate from the lower stop plate 45 until the third fixing block 43 is spaced from the lower stop plate 45 by a predetermined spacing H, and the actuation rod 32 stops the downward extension. During the downward displacement of the actuation rod 32, the second fixing block 42 continuously moves downward to press against the positioning seat 461 to move downward, compressing the second elastic element 463. The lower stop plate 45 is tightly pressed to seal the second intercommunication port 16, isolating the lower chamber 15 from the tank T (see FIG. 1). Gas suction of the tank T is prevented, and the time required for creating a near vacuum state in the upper and lower chambers 14 and 15 can be shortened.

On the other hand, the gas suction source E can suck the gas in the upper chamber 14 via the gas suction pipe P. Since the upper chamber 14 intercommunicates with the lower chamber 15, the upper and lower chambers 14 and 15 can gradually reach the near vacuum state, creating a negative pressure in the treatment container 1. Thus, the filthy substances, such as sludge, fecal sewage, or chemical pollutants, can enter the upper chamber 14 via the inlet 11 and then enter the lower chamber 15 via the first intercommunication port 131. Although a negative pressure is created in the treatment container 1, the second elastic element 463 continuously presses against the lower stop plate 45 to assure reliable closing of the second intercommunication port 16 by the lower stop plate 45. As a result, the lower stop plate 45 will not be lifted towards an interior of the lower chamber 15 under the pressure difference between the exterior pressure and the interior pressure of the treatment container 1.

Figure 4:
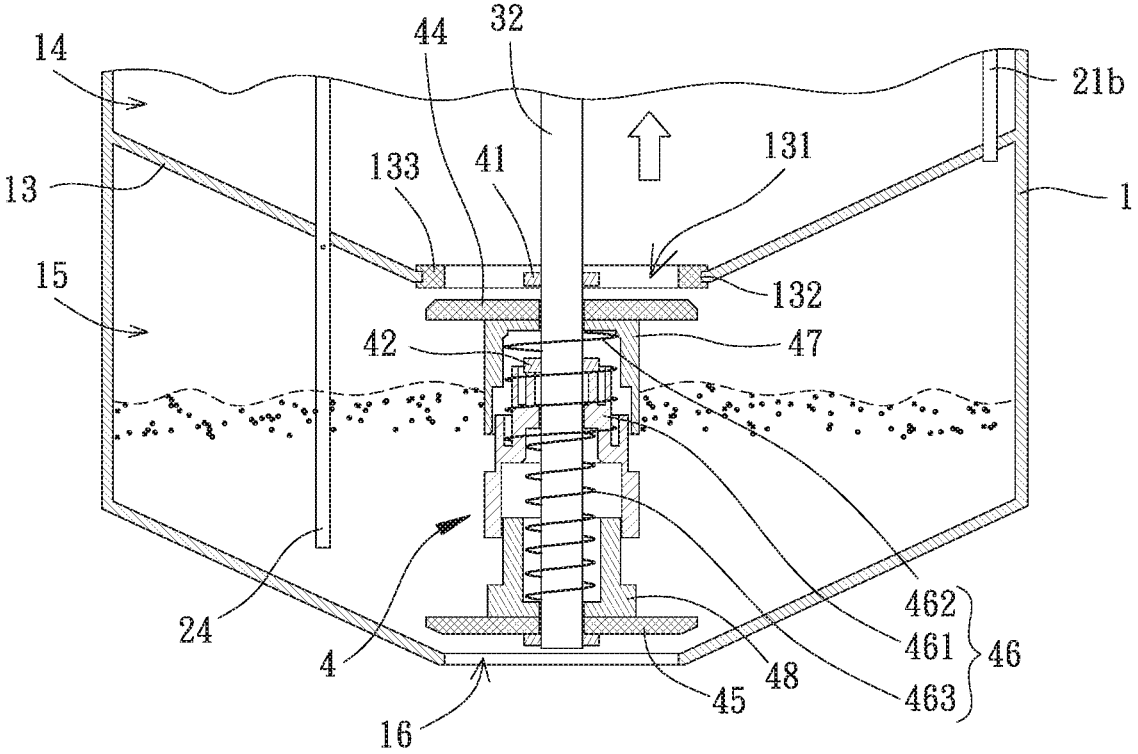
FIG. 4 is a portion of FIG. 2, with a second intercommunication port opened.

With reference to FIGS. 3 and 4, when the liquid level detector 24 detects that the liquid level in the lower chamber 15 reaches a predetermined value, the first control valve 21 is switched to the closed state, such that the first duct 21*a* does not intercommunicate with the second duct 21*b*, and the second duct 21*b* intercommunicates with the third duct 21*c*. Thus, the pressure in the lower chamber 15 gradually balances with the outside of the treatment container 1. Furthermore, the actuation cylinder 31 controls the actuation rod 32 to retract upwards, and the first, second, and third fixing blocks 41, 42, and 43 jointly move upwards. During an initial stage of the upward movement of the actuation rod 32, since the second fixing block 42 no longer presses against the positioning seat 461, the compressed second elastic element 463 gradually returns. Nevertheless, since the third fixing block 43 is still spaced from the lower stop plate 45 by the predetermined spacing H, the lower stop plate 45 still temporarily closes the second intercommunication port 16 under the elastic force of the second elastic element 463. With the upward movement of the actuation rod 32, the spacing between the third fixing block 43 and the lower stop plate 45 gradually reduces. After the second elastic element 463 returns to its original state, the third fixing block 43 moves upward to a position pressing against the lower stop plate 45 to thereby actuate the lower stop plate 45 upwards, thereby opening the second intercommunication port 16. Thus, the filthy substances stored in the lower chamber 15 can be discharged into the tank T (see FIG. 1) via the second intercommunication port 16.

Figure 5:
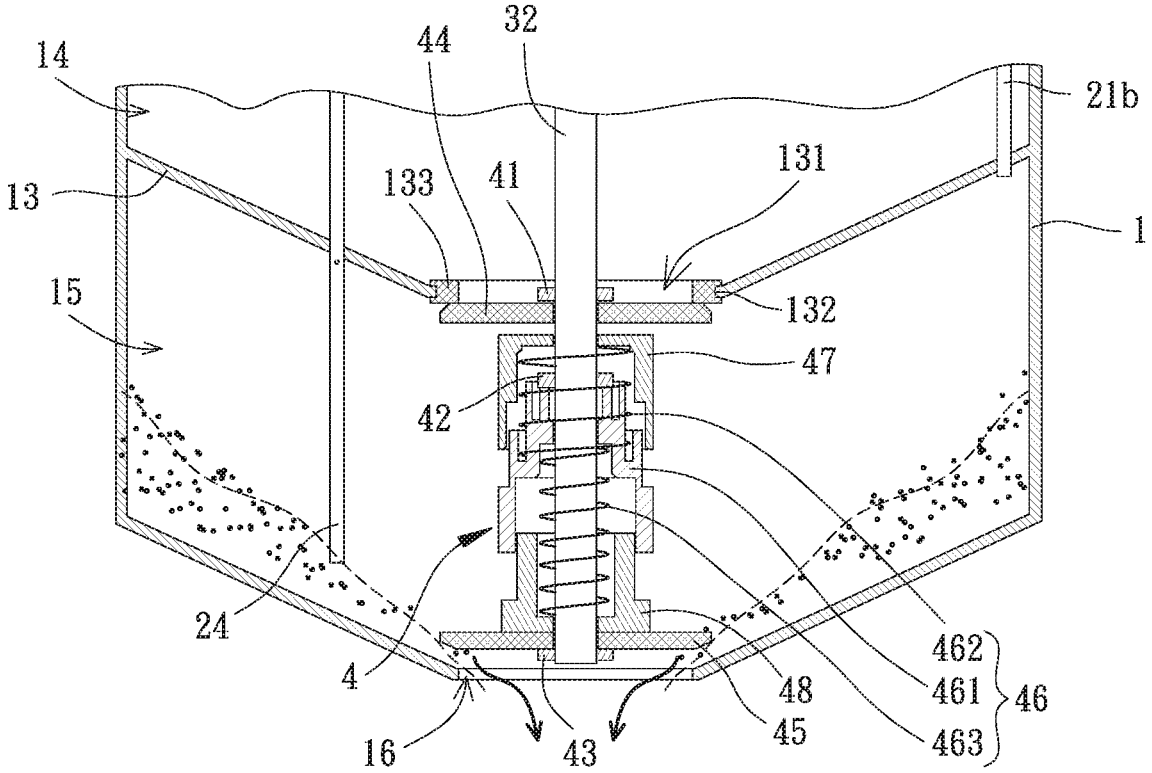
FIG. 5 is a portion of FIG. 2, illustrating discharge of filthy substances.

With reference to FIGS. 4 and 5, when the second intercommunication port 16 is open, due to the wind pressure from the tank T (see FIG. 1) and the near vacuum state maintained in the upper chamber 14 resulting from continuous gas suction, the upper stop plate 44 can overcome the gravitational force by the pressure difference of the upper and lower chambers 14 and 15 and, thus, floats upwards. The first intercommunication port 131 is rapidly closed to maintain the upper chamber 14 in the vacuum state, permitting continuous feeding (see FIG. 6).

Figure 6:
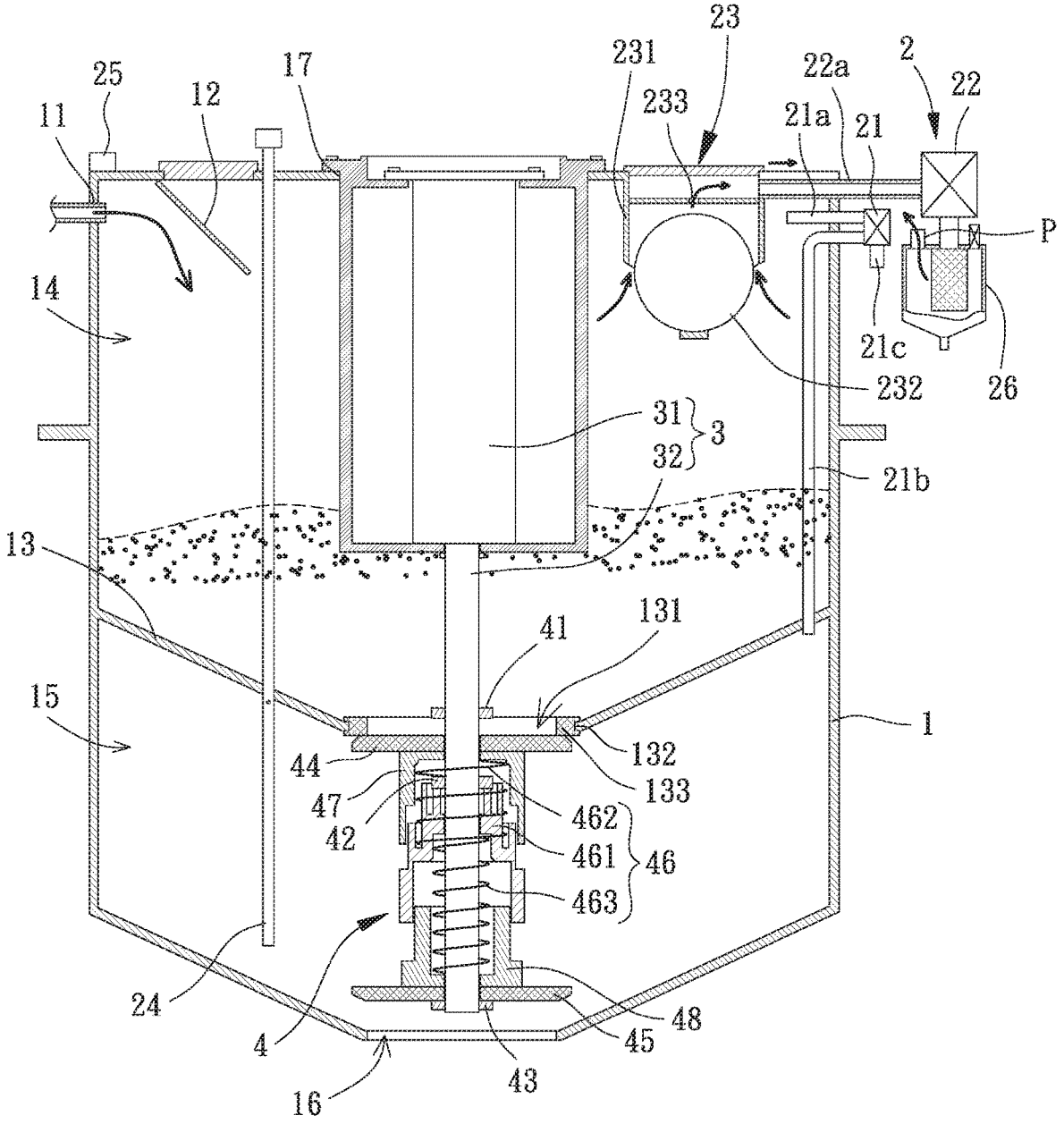
FIG. 6 is a view similar to FIG. 2, with a first intercommunication port closed for continuous suction of filthy substances.

With reference to FIG. 6, when the period of time of release for the lower chamber 15 set by the timer 25 expires, the first control valve 21 is switched to the open state, such that the first duct 21*a* restores intercommunication with the second duct 21*b*, and the second duct 21*b* does not intercommunicate with the third duct 21*c*. The gas suction source E (see FIG. 1) still operates to suck gas out of the upper chamber 14 and the lower chamber 15, and the actuation rod 32 extends downwards again to the position shown in FIG. 3 in which the lower stop plate 45 closes the second intercommunication port 16. Thus, the lower chamber 15 gradually reaches the near vacuum state. Furthermore, during the downward extension of the actuation rod 32, under the action of the weight of the filthy substances in the upper chamber 14 and the action of the downwardly moving first fixing block 41 pressing against the upper stop plate 44 to leave the first intercommunication port 131, the upper stop plate 44 rests on the top end of the first anti-fouling tank 47, and the first elastic element 462 provides a buffering effect. Thus, the first intercommunication port 131 is open, and the filthy substances in the upper chamber 14 enters the lower chamber 15 via the first intercommunication port 131. When the liquid level detector 24 detects that the liquid level in the lower chamber 15 reaches the predetermined value, the first control valve 21 is switched to the closed state, and the actuation rod 32 retracts upwards. The procedure is repeated to complete cleaning of the filthy substances, such as sludge, fecal sewage, or chemical pollutants with high efficiency.

Figure 7:
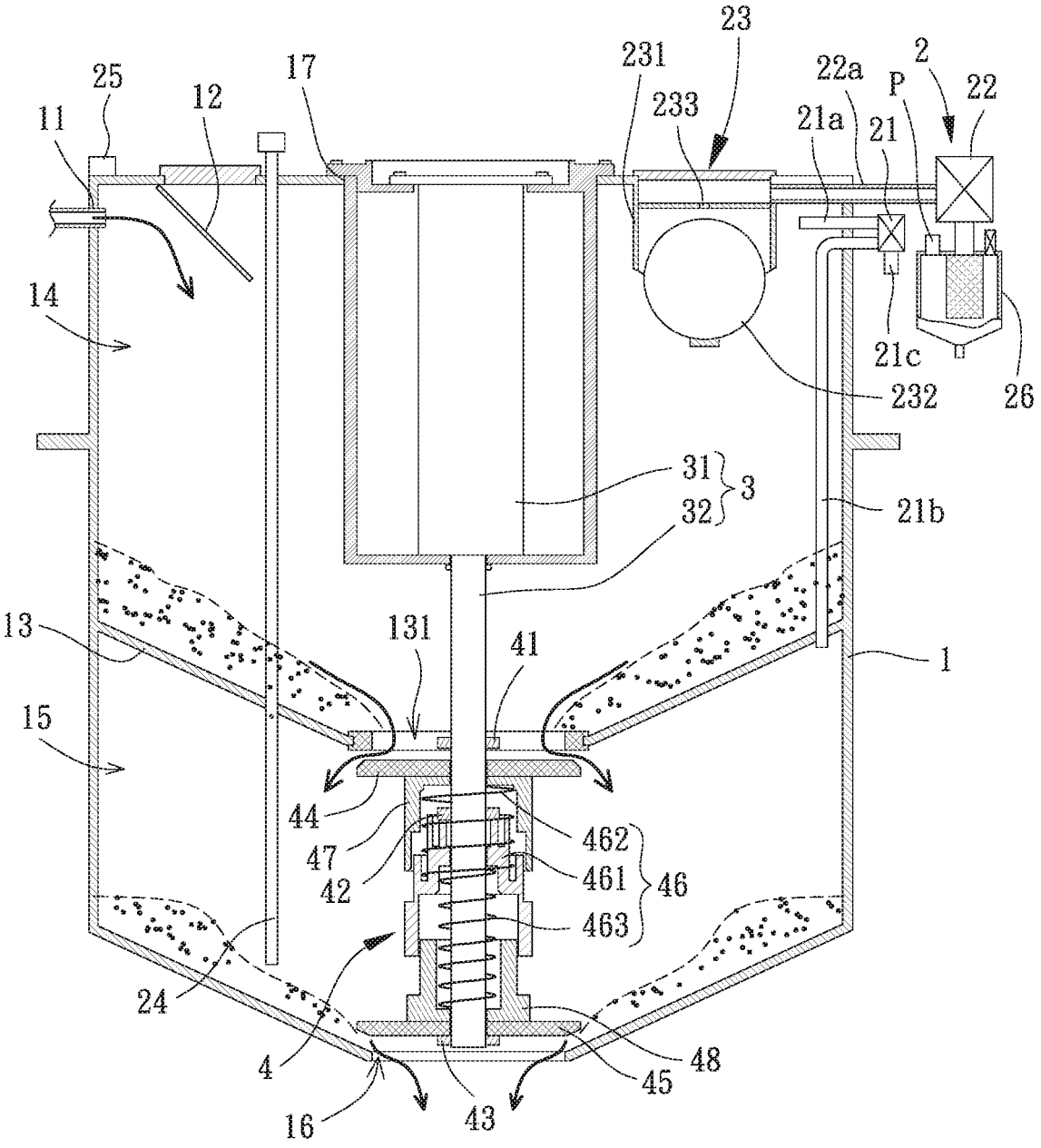
FIG. 7 is a view similar to FIG. 2, with the second intercommunication port failed to close.

With reference to FIG. 7, when the upward or downward movement of the actuation rod 32 cannot be precisely controlled due to abnormality of the actuation cylinder 31, even if the lower stop plate 45 cannot close the second intercommunication port 16 due to abnormality, the first control valve 21 intercommunicating the first duct 21*a* with the second duct 21*b* permits a balance between the pressure in the lower chamber 15 and the pressure in the upper chamber 14. Furthermore, under the action of the weight of the filthy substances stored in the upper chamber 14, the upper stop late 44 can fall along the actuation rod 32 to open the first intercommunication port 131. Thus, the filthy substances flowing into the upper chamber 14 enters the lower chamber 15 via the first intercommunication port 131 and is then discharged into the tank T (see FIG. 1) after passing through the second intercommunication port 16. Accordingly, even if the actuation cylinder 31 is abnormal, the suction operation of the filthy substances can still proceed normally without hazard.

Figure 8:
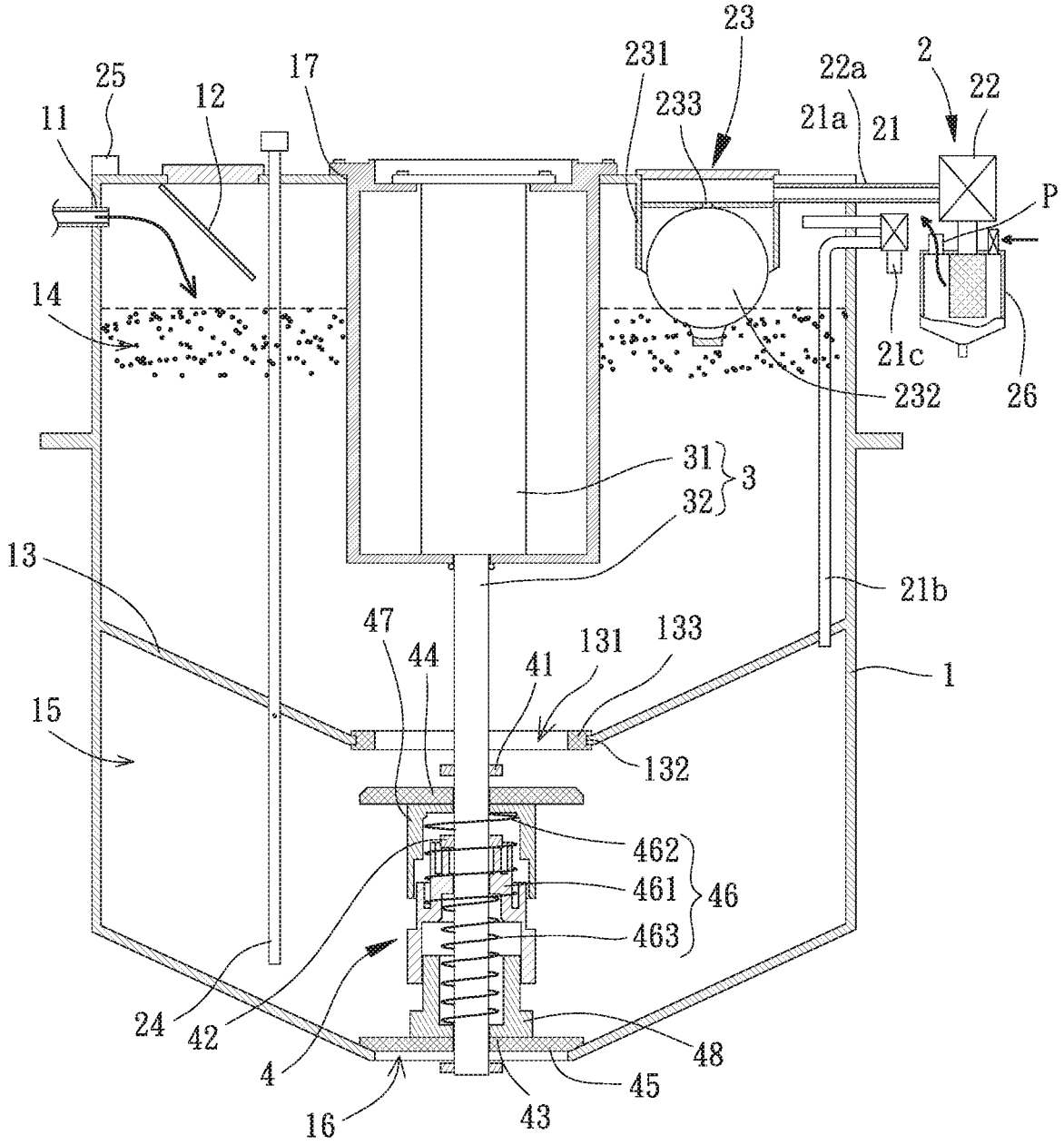
FIG. 8 is a view similar to FIG. 2, with an actuation rod failed to retract.

With reference to FIG. 8, when the retraction of the actuation rod 32 cannot be precisely controlled as the liquid level detector 24 is out of order or the actuation cylinder 31 is abnormal, the second intercommunication port 16 remains closed by the lower stop plate 45 on the actuation rod 32. Since the lower chamber 15 cannot be cleaned at regular time, the upper stop plate 44 will not close the first intercommunication port 131, such that the lower chamber 15 and the upper chamber 14 are gradually filled with filthy substances, such as sludge, fecal sewage, or chemical pollutants. Thus, when the filthy substances leak into the bottom of the housing 231 of the protecting unit 2, the float 232 floats upward to block the vent 233, thereby blocking the intercommunication between the upper chamber 14 and the fourth duct 22*a*. As a result, the filthy substances are prevented from being sucked into the fourth duct 22*a*, and the filthy substances, such as sludge, fecal sewage, or chemical pollutants, are prevented from being continuously sucked into the upper chamber 14.

With reference to FIG. 1 again, the pump-storage device according to the present invention only has to proceed with vacuum operation of the treatment container 1 of a smaller size. In an example of a treatment container 1 having a radius of 42.5 cm and a height of 65 cm, the volume is 368,655 $cm^3$ (42.5 cm×42.5 cm×3.14×65 cm). The cross sectional contact area between the filthy substances in the treatment container 1 and the vacuum area in the treatment container 1 is only 5,671 $cm^2$ (42.5 cm×42.5 cm×3.14). Taking a tank T having a radius of 97.5 cm and a height of 560 cm as an example, the volume is 16,715,790 $cm^3$ (97.5 cm×97.5 cm×3.14×560 cm). In a conventional pumping operation of the tank T, the cross sectional contact area between the volatile organic substances in the treatment container 1 and the vacuum area in the treatment container 1 is 109,200 $cm^2$ (97.5 cm×97.5 cm×3.14), which is 19.26 (109,200/5,671) times of that of the pump-storage device according to the present invention. Namely, the pump-storage device according to the present invention can reduce the air pollution by nearly 95%, because the air pollution caused by the pump-storage device according to the present invention is only about 5% (1/19.26) of that caused by conventional operations for treating the tank T. Furthermore, the time required for sucking the treatment container 1 of a smaller size is about 45 (16,715,790 $cm^3$/368,655 $cm^3$) times fastener than that required by conventional operations for treating the tank T.

With reference to FIG. 2, in this embodiment, to permit easy installation and maintenance, the treatment container 1 includes an upper hole 17 in a top end thereof, and the partitioning board 13 includes a lower hole 132. The width W1 of the upper hole 17 and the width W2 of the lower hole 132 are larger than the diameter W3 of the lower stop plate 45. Thus, the lower stop plate 45 pre-mounted to the actuation rod 32 can pass through the upper hole 17 and the lower hole 132 for easier subsequent repair and replacement. Furthermore, after the lower stop plate 45 passes through the lower hole 132, an annular pad 133 can be mounted to the lower hole 132 and can define the first intercommunication port 131. Furthermore, the diameter W4 of the first intercommunication port 131 is smaller than the diameter W3 of the lower stop plate 45, such that the lower stop plate 45 seals the first intercommunication port 131 from below.

In view of the foregoing, the pump-storage device and the pump-storage sewage truck according to the present invention only have to proceed with vacuum operation of the treatment container 1 with a smaller volume, such that a small-size gas suction source E can be used to reach the near vacuum state in a short period of time, rapidly starting the cleaning operation. This not only effectively reduces the operational cost of the pump-storage sewage truck but significantly improves the efficiency of the pumping operation. Furthermore, the pump-storage device according to the present invention includes the intercommunication control module 4 using the elastic unit 46 to more precisely control the suction or discharge of the filthy substances, also improving the pumping operation efficiency.

Furthermore, the pump-storage device according to the present invention uses the filter to filter volatile substances in a gas or liquid in a to-be-pumped environment before discharge, reducing air pollution caused by odor or toxic gases flowing into the environment.

Although specific embodiments have been illustrated and described, numerous modifications and variations are still possible without departing from the scope of the invention. The scope of the invention is limited by the accompanying claims.

The invention claimed is:

1. A pump-storage device comprising:

a treatment container including an interior separated by a partitioning board into an upper chamber and a lower chamber, wherein the upper chamber intercommunicates with the lower chamber via a first intercommunication port, wherein the treatment container further includes an inlet intercommunicating with the upper chamber and a second intercommunication port intercommunicating the lower chamber with an outside;

a switching module including a first control valve and a second control valve, wherein the first control valve is configured to control intercommunication between the upper chamber and the lower chamber, and wherein the second control valve is configured to control intercommunication between the upper chamber and a gas suction source;

a telescopic module including an actuation rod and an actuation cylinder controlling telescopic movement of the actuation rod, wherein the actuation rod extends through the first intercommunication port; and an intercommunication control module including a first fixing block, a second fixing block, and a third fixing block which are mounted from top to bottom in sequence on the actuation rod, wherein an upper stop plate is disposed between the first fixing block and the second fixing block, wherein a lower stop plate is disposed between the second fixing block and the third fixing block, and wherein the upper stop plate and the lower stop plate are elastically supported by an elastic unit.

2. The pump-storage device as claimed in claim 1, wherein the elastic unit includes a positioning seat having two ends abutting against a first elastic element and a second elastic element, respectively, wherein the first elastic element elastically abuts against the upper stop plate, and wherein the second elastic element elastically abuts against the lower stop plate.

3. The pump-storage device as claimed in claim 2, wherein the intercommunication control module includes a first anti-fouling sleeve and a second anti-fouling sleeve, wherein the first anti-fouling sleeve and the second anti-fouling sleeve are movably mounted around the actuation rod, wherein the first anti-fouling sleeve is located above the positioning seat, wherein a projection of the first anti-fouling sleeve in a radial direction overlaps with a projection of an end of the positioning seat in a radial direction, the second anti-fouling sleeve is located below the positioning seat, and wherein a projection of the second anti-fouling sleeve overlaps with a projection of another end of the positioning seat.

4. The pump-storage device as claimed in claim 2, wherein the first stop plate and the first fixing block have a gap therebetween when the first elastic element and the second elastic element are not compressed by an external force.

5. The pump-storage device as claimed in claim 2, wherein the second elastic element is biased to elastically press against the lower stop plate and to press the positioning seat against the second fixing block.

6. The pump-storage device as claimed in claim 1, wherein the first control valve intercommunicates with the upper chamber via a first duct, intercommunicates with the lower chamber via a second duct, and intercommunicates with the outside of the treatment container via a third duct, wherein when the control valve controls the first duct to intercommunicate with the second duct, the second duct does not intercommunicate with the third duct, and wherein when the first control valve controls the first duct not to intercommunicate with the second duct, the second duct intercommunicates with the third duct.

7. The pump-storage device as claimed in claim 1, wherein the second control valve intercommunicates with the upper chamber via a fourth duct, wherein a protecting unit includes a housing connected to the fourth duct, wherein the housing includes a bottom intercommunicating with the upper chamber, wherein a float is received in the housing, wherein the housing includes a vent located above the float.

8. The pump-storage device as claimed in claim 1, wherein the switching module includes a liquid level detector configured to detect a liquid level in the lower chamber, wherein when the liquid level detector detects that the liquid level reaches a predetermined value, the first control valve is switched between an open state and a closed state.

9. The pump-storage device as claimed in claim 1, wherein the switching module includes a timer configured to set a period of time of release, and wherein when the period of time of release expires, the first control valve is switched to an open state.

10. A pump-storage sewage truck comprising the pump-storage device as claimed in claim 1, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

11. A pump-storage sewage truck comprising the pump-storage device as claimed in claim 2, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

12. A pump-storage sewage truck comprising the pump-storage device as claimed in claim 3, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

13. A pump-storage sewage truck comprising the pump-storage device as claimed in claim 4, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

14. A pump-storage sewage truck comprising the pump-storage device as claimed in claim 5, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

15. A pump-storage sewage truck comprising the pump-storage device as claimed in claim 6, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

16. A pump-storage sewage truck comprising the pump-storage device as claimed in claim 7, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

17. A pump-storage sewage truck comprising the pump-storage device as claimed in claim 8, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

18. A pump-storage sewage truck comprising the pump-storage device as claimed in claim 9, a tank, and a transportation tool, wherein the pump-storage device is assembled to the tank, wherein the second intercommunication port of the treatment container intercommunicates with an interior of the tank, and wherein the tank and the gas suction source are mounted to the transportation tool.

* * * * *